US005691602A

United States Patent [19]

Suzuki

[11] Patent Number: 5,691,602

[45] Date of Patent: Nov. 25, 1997

[54] MULTIPLE CAVITY KLYSTRON

[75] Inventor: Wako Suzuki, Tokyo, Japan

[73] Assignee: NEC Corporation, Tokyo, Japan

[21] Appl. No.: 534,849

[22] Filed: Sep. 27, 1995

[30] Foreign Application Priority Data

Oct. 31, 1994 [JP] Japan ..... 6-266879

[51] Int. Cl.[6] ..... H01J 23/20; H01P 7/06

[52] U.S. Cl. ..... 315/5.48; 315/5.54; 333/233

[58] Field of Search ..... 315/5.39, 5.46, 315/5.47, 5.48, 5.49, 5.53, 5.54; 331/83; 330/44, 45; 333/231, 232, 233

[56] References Cited

U.S. PATENT DOCUMENTS 3,614,518 10/1971 Schmidt ..... 315/5.46 X

FOREIGN PATENT DOCUMENTS 102943 8/1979 Japan ..... 333/232

185841 8/1986 Japan ..... 315/5.46

295336 12/1987 Japan ..... 315/5.53

64-43546 3/1989 Japan .

1-165551 11/1989 Japan .

2-18254 2/1990 Japan .

5266814 10/1993 Japan ..... 315/5.54

*Primary Examiner*—Benny T. Lee

*Attorney, Agent, or Firm*—Whitham, Curtis, Whitham & McGinn

[57] ABSTRACT

A multiplecavity klystron, which has a wide range of frequencies in which it can be used and is capable of operating at high frequencies, comprises first and second resonant cavities. At least one of resonant frequencies in TEM and TE11 modes of the second resonant cavity is lower than the operating frequency of the first resonant cavity, and the other of resonant frequencies in TEM and TE11 modes of the second resonant cavity is different from the operating frequency of the first resonant cavity.

10 Claims, 8 Drawing Sheets

MULTIPLE CAVITY KLYSTRON

BACKGROUND OF THE INVENTION

1. Field of the Invention

The present invention relates to a mechanism for varying the tuned frequencies of cavities of a multiple cavity klystron.

2. Description of the Related Art

The multiple cavity klystron is a typical microwave electron-beam tube for amplifying microwaves with an electron beam for use in microwave satellite communications.

Another microwave electron-beam tube for amplifying microwaves is a traveling-wave tube. The multiple cavity klystron and the traveling-wave tube differ from each other with respect to a RF circuit which causes an input signal wave and an electron beam to interact with each other. The multiple cavity klystron comprises a plurality of interconnected resonant cavities for passing an electron beam therethrough. The electron beam is speeded up and slowed down by a RF voltage developed in the resonant cavities for thereby amplifying the microwave. The traveling-wave tube has its input and output ends interconnected at high frequencies, and amplifies a microwave by matching its phase speed to an electron beam that passes between the input and output ends.

The multiple cavity klystron is more durable and stable than the traveling-wave tube, but has a narrower band because it amplifies a microwave with the resonant cavities. Therefore, the multiple cavity klystron usually has a tuning device for varying the resonant frequencies in order to maintain the frequency range that is used. The structure of a multiple cavity klystron will be described below with reference to FIG. 1 of the accompanying drawings.

As shown in FIG. 1, the multiple cavity klystron comprises an electron gun 508 for generating and emitting an electron beam, a RF circuit 509 for causing high-frequency electric energy to interact with the electron beam, a collector 510 for catching the electron beam, and a focusing device 511 for focusing the electron beam.

The RF circuit 509 is composed of a plurality of resonant cavities, a tuning device associated with each of the resonant cavities for varying the respective inductances of the resonant cavities so as to vary resonant frequencies thereof, and a tuning mechanism 512 connected to and supporting the tuning device.

FIGS. 2(A), 2(B) and 3(A), 3(B) of the accompanying drawings show resonant cavities, respectively, disclosed in Japanese laid-open utility model publications Nos. 2-18254 and 1-165551, respectively. FIGS. 2(A) and 3(A) are longitudinal cross-sectional views of the resonant cavities, respectively, and FIGS. 2(B) and 3(B) are transverse cross-sectional views of the resonant cavities, respectively.

As shown in FIGS. 2(A), 2(B) and 3(A), 3(B), the resonant cavities, shown in FIGS. 2(A) and 2(B) as 601 and in FIGS. 3(A) and 3(B) as 701 have respective cavity casings shown in FIGS. 2(A) and 2(B) as 602 and shown in FIGS. 3(A) and 3(B) as 702, respective drift tubes shown in FIGS. 2(A) and 2(B) as 603, as shown in FIGS. 3(A) and 3(B) as 703, respective tuning devices shown in FIGS. 2(A) and 2(B) as 604, and shown in FIGS. 3(A) and 3(B) as 704, respective tuning device supports shown in FIGS. 2(A) and 2(B) as 605, and shown in FIGS. 3(A) and 3(B) as 705, respective connecting rods shown in FIGS. (2A) and 2(B) as 606, as shown in FIGS. 3(A) and 3(B) as 706, and respective bellows shown in FIGS. 2(A) and 2(B) as 607, and shown in FIGS. 3(A) and 3(B) as 707.

The respective operating frequency of the resonant cavities 601, 701 increases as the tuning devices 604, 704 are respectively displaced closer to the drift tubes 603, 703, reducing the inductance. The respective operating frequency of resonant cavities 601, 701 decreases as the tuning devices 604, 704 are respectively displaced away from the drift tubes 603, 703. With the conventional arrangements shown in FIGS. 2(A), 2(B) and 3(A), 3(B), other resonant cavities shown in FIGS. 2(A) and 2(B) as 601', and shown in FIGS. 3(A) and 3(B) as 701' are defined by the respective tuning devices 604, 704, the respective tuning device supports 605, 705, the respective connecting rods 606,706, and respective walls having holes through which the connecting rods 606, 706 extend. The resonant cavities 601', 701' are respectively positioned across the tuning devices 604, 704 from the resonant cavities 601, 701 which serve as main resonant cavities on the other side of the tuning devices 604, 704.

A process of determining the resonant frequency of the resonant cavity 601' will be described below with reference to FIGS. 2(A) and 2(B).

It is assumed that the distance from the tuning device 604 to the wall having the hole through which the connecting rod 606 extends is represented by L (See FIG. 2(A)), the length of the tuning device support 605 in the axial direction of the drift tube 603 by C (See FIG. 2(A)), the length of the tuning device support 605 in the direction perpendicular to the axis of the drift tube 603 by D (See FIG. 2(B)), the length of the tuning device support 605 in the direction along the connecting rod 606 by E (See FIG. 21(A)), the distance between upper and lower inner wall surfaces of the cavity casing 602 by A (See FIG. 2(A)), the distance between left and right inner wall surfaces of the cavity casing 602 by B (See FIG. 2(B)), and the diameter of the connecting rod 606 by R (See FIG. 2(B)).

The resonant frequency, $f(TE_{11N})$, of the resonant cavity 601' in the TE11 mode is given as follows:

$$f(TE_{11N})=C\times\{[1/\lambda^2+1/(2\times L/N)^2]\}^{1/2}$$

where C is the speed of light, In is a natural number, and $\lambda$ is defined as $\lambda=A+B+\pi\times R/2$ if the dimension E is sufficiently small, and $\lambda=A+B+C+D$ if the dimension E is sufficiently large. The value of $\lambda$ varies between the above values depending on the dimension E.

The resonant frequency, $f(TEM_N)$, of the resonant cavity 601' in the TEM mode is given as follows:

$$f\,temN=C\times\{[1/(2\times L/N)^2]\}^{1/2}$$

where C is the speed of light and N is a natural number.

The dimension L varies when the tuning device 604 is moved. As described above, the operating frequency of the main resonant cavity 601 increases as the tuning device 604 is displaced closer to the drift tube 603, reducing the inductance, and decreases as the tuning device 604 is displaced away from the drift tube 603.

However, the resonant frequencies $f(TEM_N)$, $f(TE_{11N})$ of the other resonant cavity 601' decrease as the tuning device 604 is displaced closer to the drift tube 603, and increase as the tuning device 604 is displaced away from the drift tube 603.

In either one of the arrangements shown in FIGS. 2(A), 2(B) and 3(A), 3(B) which are disclosed in Japanese laid-open utility model publications Nos. 2-18254 and 1-165551, the dimensions L, E are made small such that all the resonant frequencies in the TEM and $TE_{11}$ modes of the other resonant cavities 601', 701' are shifted to a frequency range higher than the resonant frequencies of the main resonant cavities 601, 701.

FIG. 4 of the accompanying drawings is a diagram showing the relationship between the resonant frequencies of the main resonant cavities and the resonant frequencies of the other resonant cavities of the conventional arrangements shown in FIGS. 2(A), 2(B) and 3(A), 3(B).

FIG. 5 of the accompanying drawings shows a structure combined with a tuning device for varying a capacitance as disclosed in Japanese laid-open patent publication No. 62-295336.

In FIG. 5, the illustrated structure includes a cavity casing 902, a drift tube 903, a tuning device (capacitive plate) 904, a connecting rod 906, and a bellows 907. The publication reveals that the resonant frequency of the other resonant cavity, i.e., the space defined by the bellows 907 and the connecting rod 906, is made three times greater than the resonant frequency of the main resonant cavity. In the disclosed structure ($\lambda \approx \pi/2(R+P)$, and the dimension L is smaller than ½ of the wavelength of a wave whose frequency is three times greater than the resonant frequency of the main resonant cavity, where R is the diameter of the connecting rod 906 and P is the diameter of the bellows 907.

FIG. 6 of the accompanying drawings is a diagram showing the relationship between the resonant frequency of the main resonant cavity and the resonant frequency of the other resonant cavity of the conventional arrangement shown in FIG. 5.

In recent years, the operating frequency range of a multiple cavity klystron has increased and been shifted to higher frequencies. Because of this tendency, the resonant frequency of the other resonant cavity, which has not been taken into account in the conventional multiple cavity klystron using the tuning device for varying the reactance, may possibly coincide with the resonant frequency of the main resonant cavity in the operating frequency range, as shown in FIG. 7 of the accompanying drawings.

Specifically, since the operating frequency range has increased, it has been necessary to increase the dimension L shown in FIG. 2, and a resonant cavity of a higher frequency has been necessitated in order to achieve higher frequencies. While the resonant cavity may be reduced in size, because the connecting rod which supports the tuning device and the bellows for hermetically sealing the connecting rod cannot be reduced in size on account of strength requirements. Consequently, the dimensions A, B, C, D, E, R shown in FIG. 2 necessarily become large. If the resonant frequency of the other resonant cavity is lowered to agree with the resonant frequency of the main resonant cavity, then some electric characteristics of the resonant cavity are impaired.

The impaired electric characteristics of the resonant cavity primarily include an increased leakage of high-frequency electric energy into the other resonant cavity, resulting in a reduction in the high-frequency electric energy in the main resonant cavity, and a connection of the main resonant cavity to another main resonant cavity through the other resonant cavity.

SUMMARY OF THE INVENTION

It is therefore an object of the present invention to provide a multiple cavity klystron having a wide range of frequencies in which it can be used and capable of operating at high frequencies.

To achieve the above object, there is provided in accordance with the present invention a multiple cavity klystron comprising a cavity casing, a tuning device disposed in the cavity casing for varying an inductance, a drift tube mounted on the cavity casing, a tuning device support, the tuning device being supported by the tuning device support, a connecting rod having an end connected to the tuning device support and an opposite end extending outside of the cavity casing out of contact therewith through a hole defined in a wall of the cavity casing which is positioned across the tuning device from the drift tube, and a bellows connected to a portion of the connecting rod outside of the cavity casing, thereby hermetically sealing the tuning device, the tuning device, the cavity casing, and the drift tube jointly forming a RF circuit comprising a first resonant cavity, the tuning device, the connecting rod, and the wall jointly forming a second resonant cavity other than the first resonant cavity, at least one of resonant frequencies in TEM and TE11 modes of the second resonant cavity being lower than the operating frequency of the first resonant cavity, and the other of resonant frequencies in TEM and TE11 modes of the second resonant cavity being different from the operating frequency of the first resonant cavity.

The dimension L between the tuning device of the second resonant cavity and the wall may be selected to determine the frequencies.

The tuning device support has a length C in the axial direction of the drift tube, a length D in a direction perpendicular to the axis of the drift tube, and a length E in a direction along the connecting rod. The lengths C, D, E may be selected to determine the frequencies.

The diameter R of the connecting rod may be selected to determine the frequencies.

The cavity casing has upper and lower inner wall surfaces spaced from each other by a distance A and left and right inner wall surfaces spaced from each other by a distance B. The distance A or the distance B may be selected to determine the frequencies.

With the arrangement of the present invention, attention is drawn to the resonance modes of the second or other resonant cavity, and the problems of the prior art are solved by determining the dimensions A, B, C, D, E, R, L of the other resonant cavity such that the resonant frequencies in TEM and TE11 modes of the other resonant cavity are not the same as the operating frequency of the first or main resonant cavity.

It can be seen from the equations given above in the description of the related art that the first-order frequency (N is 1) of the TEM mode of the other resonant cavity is the lowest frequency. Since the TEM mode is governed by only the dimension L, the dimension L is determined by:

$$f(TEM_1)(\text{first-order frequency of the TEM mode})=C\times[1/(2(L)2]^{1/2}<f(\text{MAIN})$$

$$f(\text{MAIN})<f(TEM_2)(\text{second-order frequency of the TEM mode})=C\times[1/(L)2]^{+\infty,f\infty\ 1/2}=f(TEM_1)+\infty\ 2^{1/2}$$

where f main is the operating frequency of the main resonant cavity and C is the speed of light. The dimensions A, B, C, D, E, R are determined such that the first-order frequency (N is 1) of the TE11 mode satisfies the following equation:

$$f(\text{MAIN})>f(TE_{111})=C\times\{[1/\lambda^2+1/(2\times L)^2]\}^{1/2}$$

or $$f(\text{MAIN})<f(TE_{111})=C(\{[1/\lambda^2+1/(2\times L)^2]\}^{1/2}$$

where $\lambda \approx A+B+\pi\times R/2$ if the dimension E is sufficiently small, and $\lambda=A+B+C+D$ if the dimension E is sufficiently large. The value of λ varies between the above values depending on the dimension E.

Summarized, the other resonant cavity is defined by determining the dimension L to satisfy the relationship: $f(TEM_N)<f(MAIN)<f(TEM_{(N+11)})$, and thereafter determining the dimensions A, B, C, D, E, R so that the resonant frequency in the TE11 mode between $f(TEM_N)$ and $f(TEM_{(N+1)})$ satisfies the relationship: $f(MAIN)\neq f(TE_{111})$.

The able and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

1st Embodiment

Figure 8A:
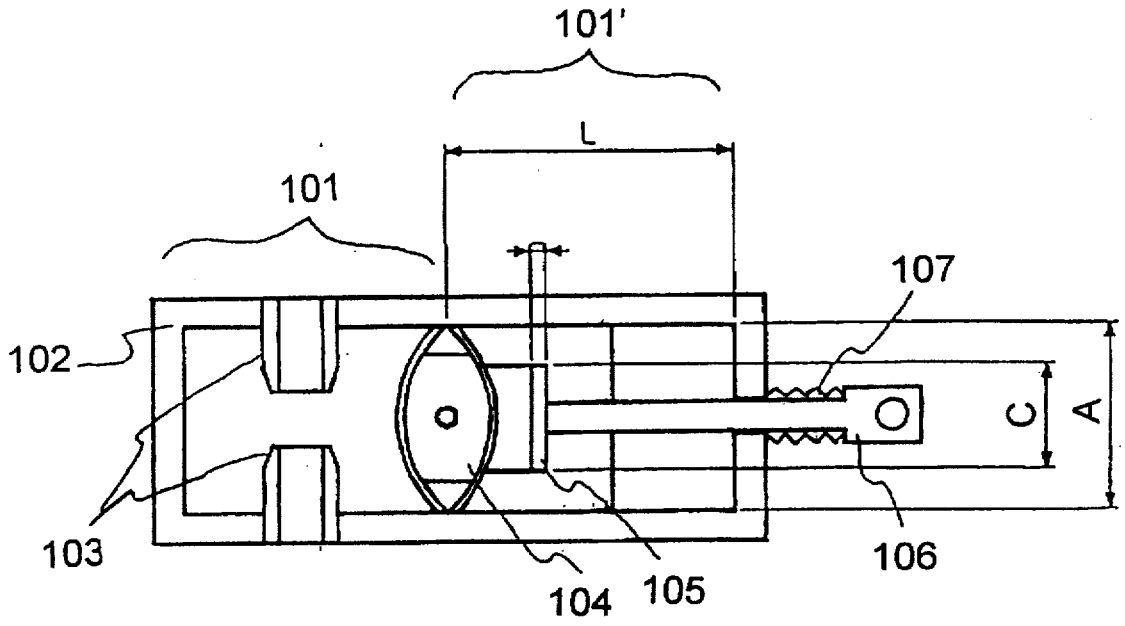
FIGS. 8(A) and 8(B) are longitudinal and transverse cross-sectional views, respectively, of a multiple cavity klystron according to a first embodiment of the present invention.
Figure 8B:
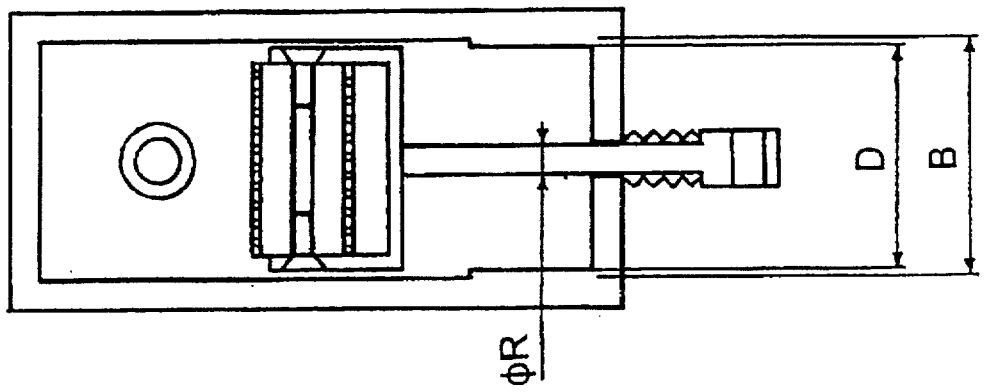

FIGS. 8(A) and 8(B) show a multiple cavity klystron according to a first embodiment of the present invention.

As shown in FIGS. 8(A) and 8(B), the multiple cavity klystron according to the first embodiment of the present invention comprises a main resonant cavity 101, another resonant cavity 101', a cavity casing 102, a drift tube 103, a tuning device 104, a tuning device support 105, a connecting rod 106, and a bellows 107.

The distance L from the tuning device 104 to a wall having a hole through which the connecting rod 106 extends is determined to satisfy the following equation:

$$f(TEM_1)=C\times[1/(2\times L)2]^{1/2}<f(MAIN)<f(TEM_2)=C\times[1/(L)2]^{1/2}=f(TEM_1)\times 2^{1/2}$$

The distance A (See FIG. 8(A)) between upper and inner wall surfaces of the cavity casing 102, the distance B (See FIG. 8(B)) between left and right inner wall surfaces of the cavity casing 102, the length C (See FIG. 8(A)) of the tuning device support 105 in the axial direction of the drift tube 103, the length D (See FIG. 8(B)) of the tuning device support 105 in the direction perpendicular to the axis of the drift tube 103, the length E of the tuning device support 105 in the direction along the connecting rod 106, and the diameter R (See FIG. 8(B)) of the connecting rod 106 are determined to satisfy the following relationship:

$$f(TE_{111})>f(MAIN)$$

In this embodiment, the above dimensions are determined to reduce λ.

The value of λ is defined as (1) $\lambda\approx A+B+\pi\times R/2$ if the dimension E is sufficiently small, and (2) $\lambda\approx A+B+C+D$ if the dimension E is sufficiently large.

The value of λ varies between the above values depending on the dimension E.

If the mode is TE111, then an electric field is concentrated in the center of the dimension L. To prevent the length E of the tuning device support 105 in the direction along the connecting rod 106 from affecting the electric field, the length E is set to ⅓ of the dimension L or less. With this arrangement, the value of λ approaches the equation in (1) above, making it possible-to minimize the diameter R of the connecting rod R.

Inasmuch as the dimensions A, B are required to accommodate the tuning device 104, the dimensions A, B are only slightly smaller than the dimensions-of the cavity casing 102 which defines the main resonant cavity 101 therein.

According to the first embodiment, the dimensions E, L are determined first, and the other dimensions are determined to satisfy the relationship: $f(TE_{111})>f(MAIN)$ depending on the diameter R of the connecting rod 106.

However, if the diameter R is too Small, the connecting rod 106 will suffer strength problems. Therefore, the diameter R is selected so as not to cause the connecting rod 106 to suffer strength problems.

Figure 10:
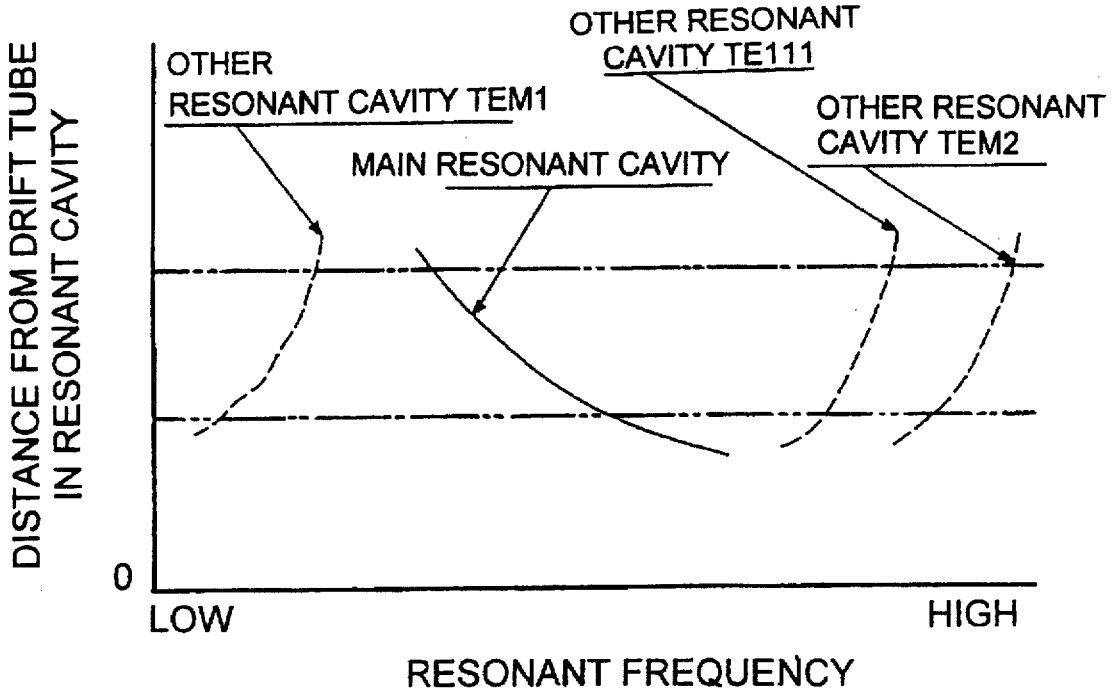
FIG. 10 is a diagram showing the relationship between the resonant frequencies of main and other resonant cavities of the multiple cavity klystron according to the first embodiment shown in FIGS. 8(A) and 8(B)

FIG. 10 illustrates the relationship between the resonant frequencies of the main and other resonant cavities 101, 101' of the multiple cavity klystron according to the first embodiment of the present invention whose dimensions are determined in the manner described above.

2nd Embodiment

Figure 9A:
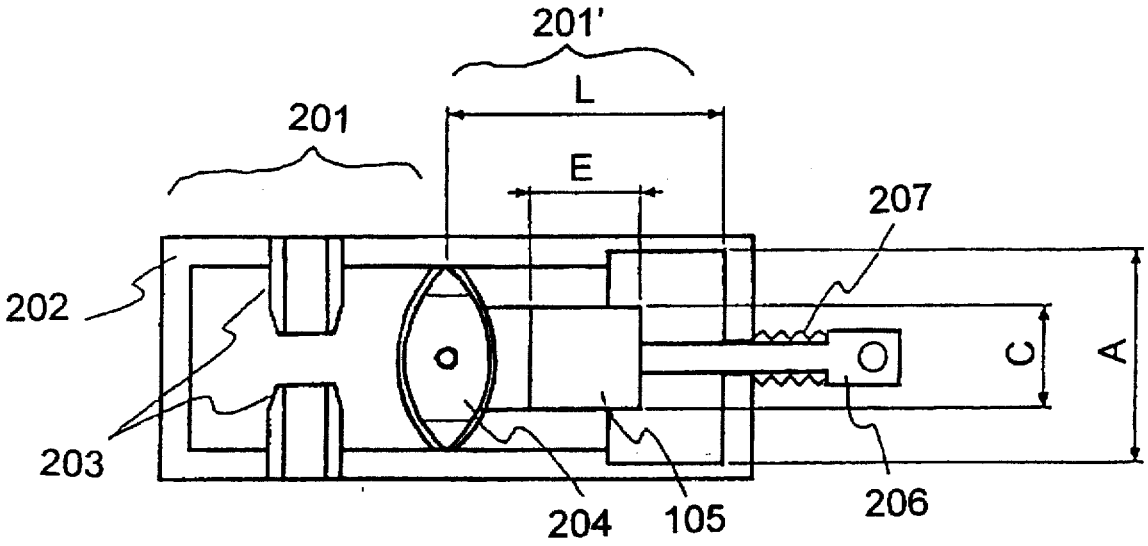
FIGS. 9(A) and 9(B) are longitudinal and transverse cross-sectional views, respectively, of a multiple cavity klystron according to a second embodiment of the present invention.
Figure 9B:
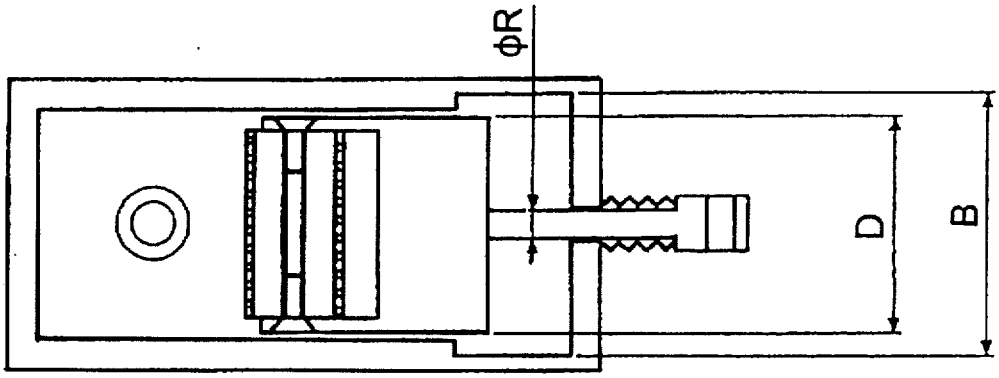

FIGS. 9(A) and 9(B) show a multiple cavity klystron according to a second embodiment of the present invention.

As shown in FIGS. 9(A) and 9(B), the multiple cavity klystron according to the second embodiment of the present invention comprises a main resonant cavity 201, another resonant cavity 201', a cavity casing 202, a drift tube 203, a tuning device 204, a tuning device support 205, a connecting rod 206, and a bellows 207.

The distance L (See FIG. 9(A)) from the tuning device 204 to a wall having a hole through which the connecting rod 206 extends is determined to satisfy the following equation:

$$f(TEM_1)=C\times[\tfrac{1}{2}(L)2]^{1/2}<f(\mathrm{MAIN})<f(TEM_2)=C\times[1/(L)2]^{1/2}=f(TEM_1)\times 2^{1/2}.$$

The distance A (See FIG. 9(A)) between upper and inner wall surfaces of the cavity casing 202, the distance B (See FIG. 9(B)) between left and right inner wall surfaces of the cavity casing 202, the length C (See FIG. 9(A)) of the tuning device support 205 in the axial direction of the drift tube 203, the length D (See FIG. 9(B)) of the tuning device support 205 in the direction perpendicular to the axis of the drift tube 203, the length E (See FIG. 9(A)) of the tuning device support 205 in the direction along the connecting rod 206, and the diameter R (See FIG. 9(B)) of the connecting rod 206 are determined to satisfy the following relationship:

$$f(TE_{111})>f(\mathrm{MAIN}).$$

In this embodiment, the above dimensions are determined to increase λ.

The value of λ is defined as (1) $\lambda=A+B+\pi\times R/2$ if the dimension E is sufficiently small, and (2) $\lambda=A+B+C+D$ if the dimension E is sufficiently large.

The value of λ varies between the above values depending on the dimension E.

If the mode is TE111, then an electric field is concentrated in the center of the dimension L. Therefore, if the dimension E is equal to or greater then ½ of the dimension L, the value of λ approaches the equation in (2) above, making it possible to increase the dimensions A, B, C, D.

Inasmuch as the dimensions C, D are required to be fall in the main resonant cavity 201, these dimensions C, D are necessarily determined. According to the second embodiment, the dimensions E, L are determined at first, and the dimensions A, B are increased, increasing the value of λ, thereby satisfying the relationship: $f(TE_{111})>f(\mathrm{MAIN})$.

Figure 11:
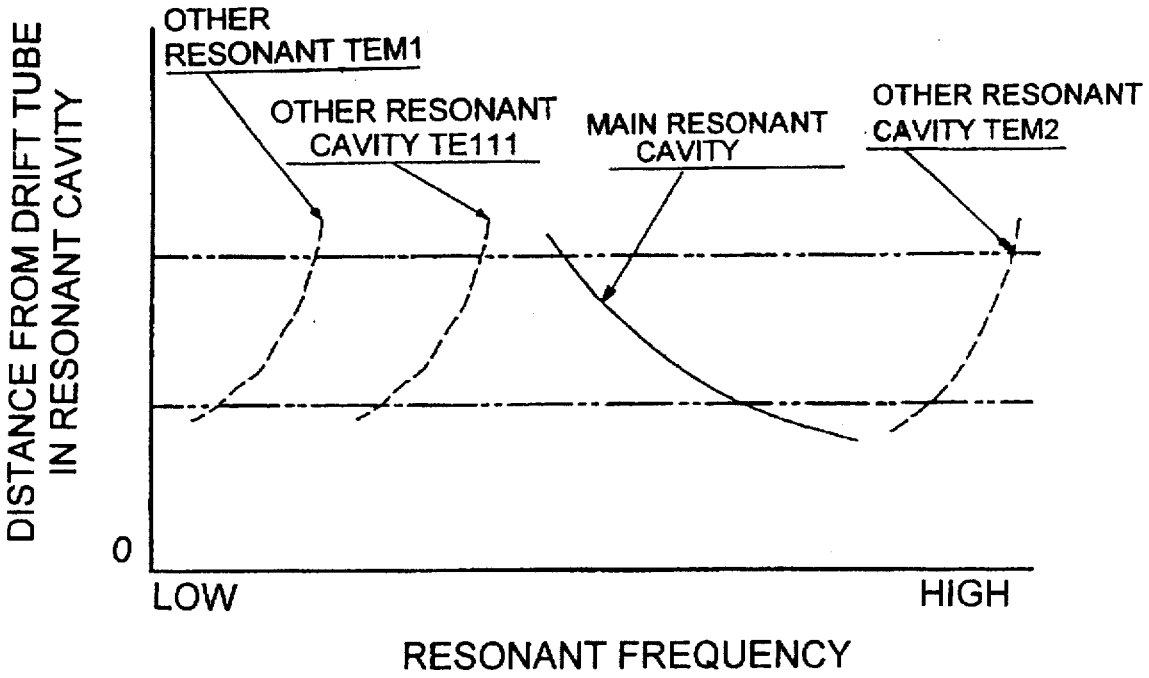
FIG. 11 is a diagram showing the relationship between the resonant frequencies of main and other resonant cavities of the multiple cavity klystron according to the second embodiment shown in FIGS. 9(A) and 9(B).

FIG. 11 illustrates the relationship between the resonant frequencies of the main and other resonant cavities 201, 201' of the multiple cavity klystron according to the second embodiment of the present invention whose dimensions are determined in the manner described above.

Even if the dimension E is equal to or smaller than ⅓ of the dimension L, it is apparent that the relationship shown in FIG. 11 can be satisfied by increasing the dimensions A, B.

Figure 1:
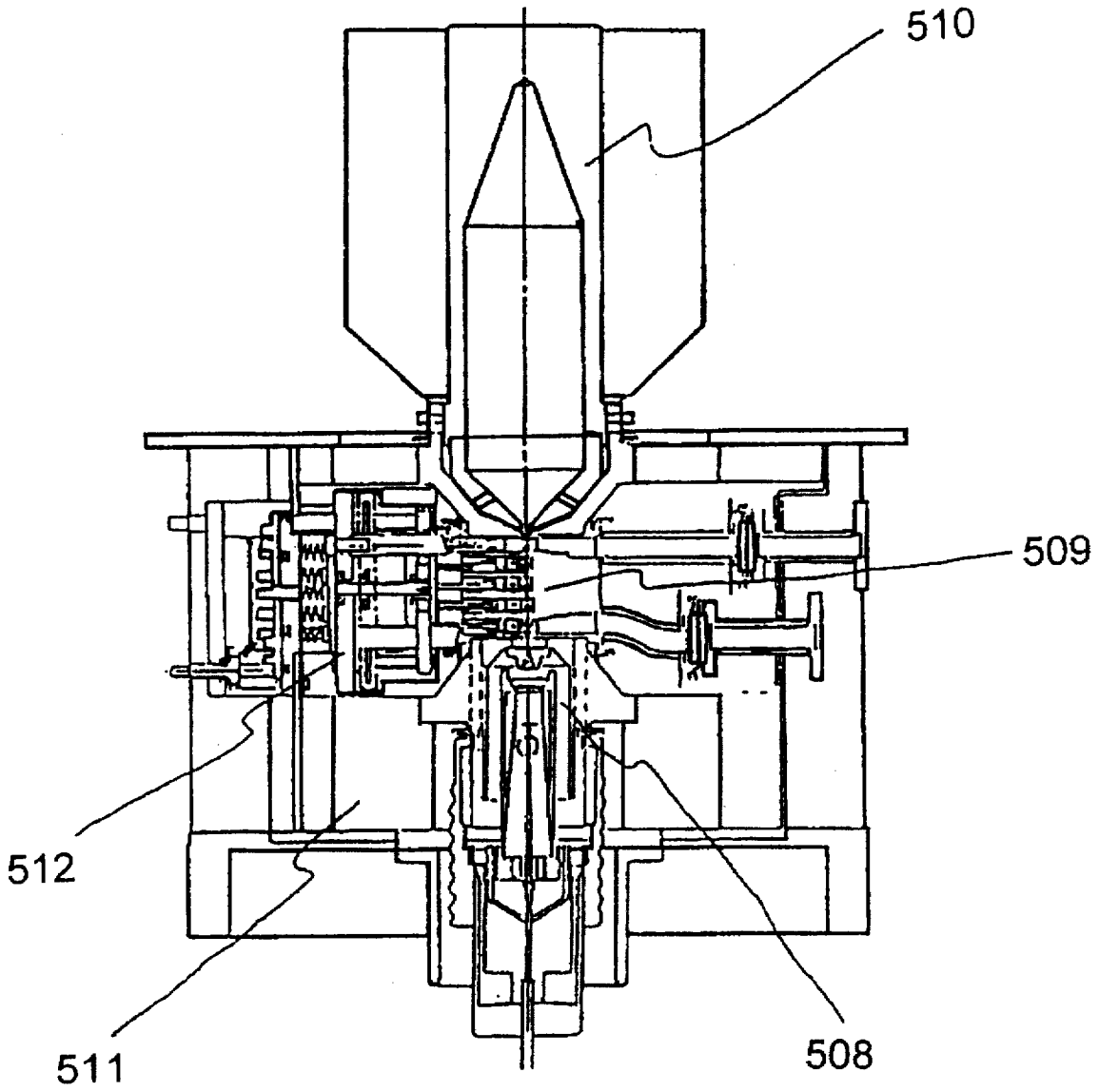
FIG. 1 PRIOR ART
FIG. 1 is a cross-sectional view of a structure of a multiplecavity klystron.
Figure 2A:
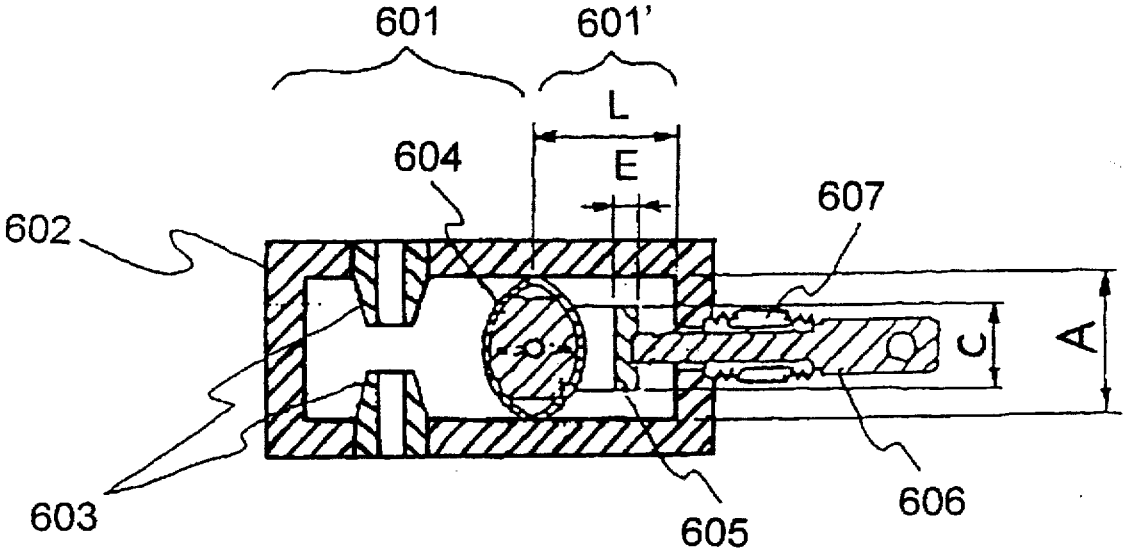
FIG.2A PRIOR ART
FIGS. 2(A) and 2(B) are longitudinal and transverse cross-sectional views, respectively, of a conventional resonant cavity.
Figure 2B:
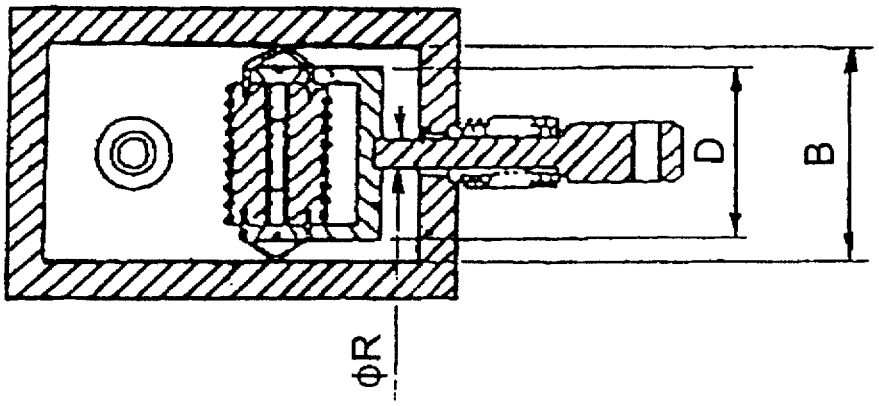
FIG.2B PRIOR ART
Figure 3A:
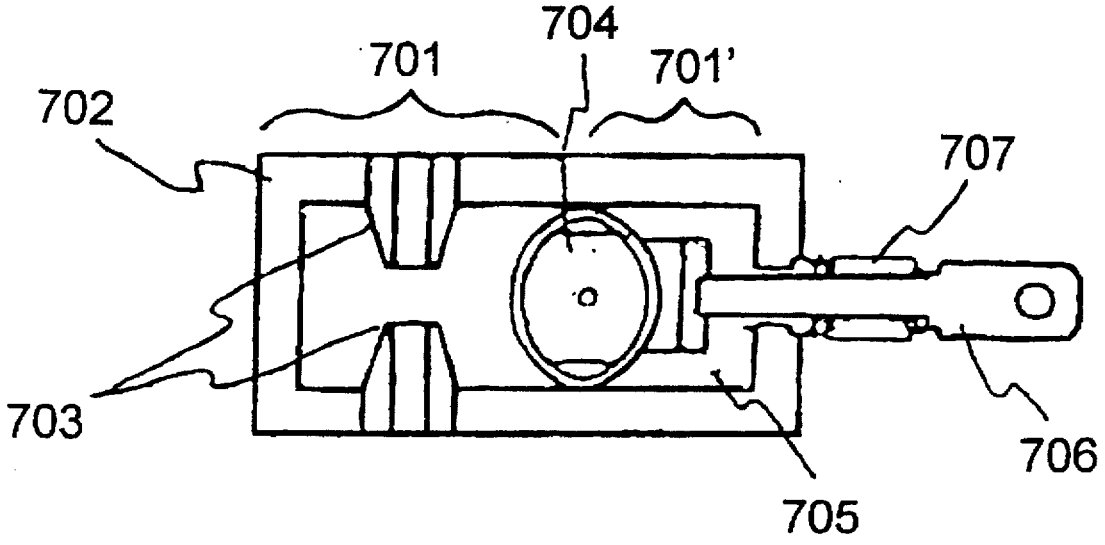
FIG.3A PRIOR ART
FIGS. 3(A) and 3(B) are longitudinal and transverse cross-sectional views, respectively, of another conventional resonant cavity.
Figure 3B:
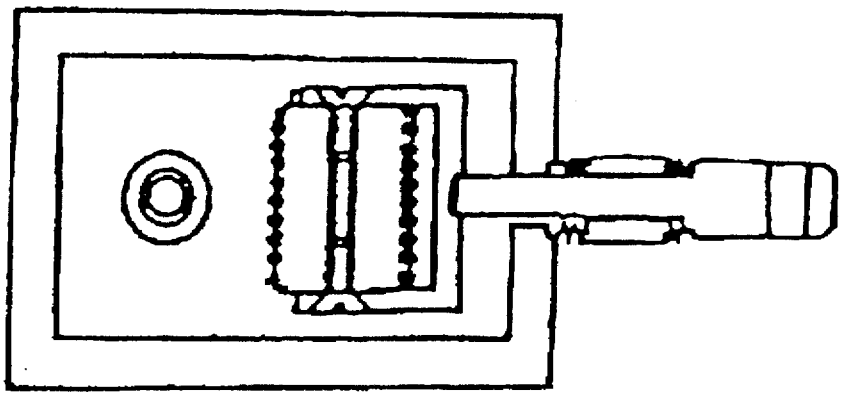
FIG.3B PRIOR ART
Figure 4:
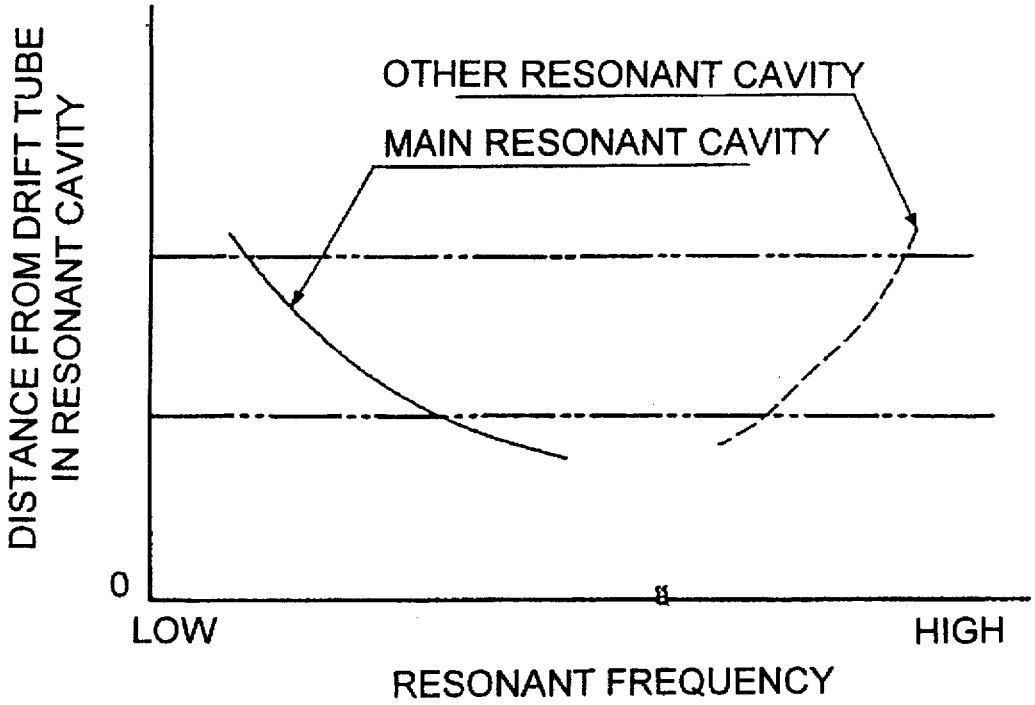
FIG.4 PRIOR ART
FIG. 4 is a diagram showing the relationship between the resonant frequencies of main resonant cavities and the resonant frequencies of other resonant cavities of the conventional arrangements shown in FIGS. 2(A), 2(B) and 3(A), 3(B)
Figure 5:
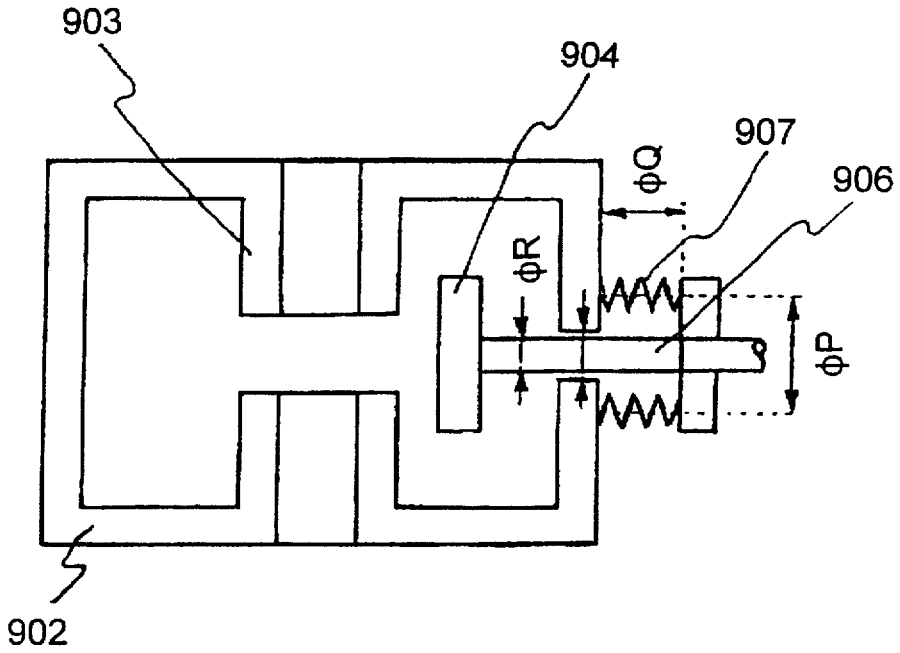
FIG.5 PRIOR ART
FIG. 5 is a cross-sectional view of another conventional resonant cavity.
Figure 6:
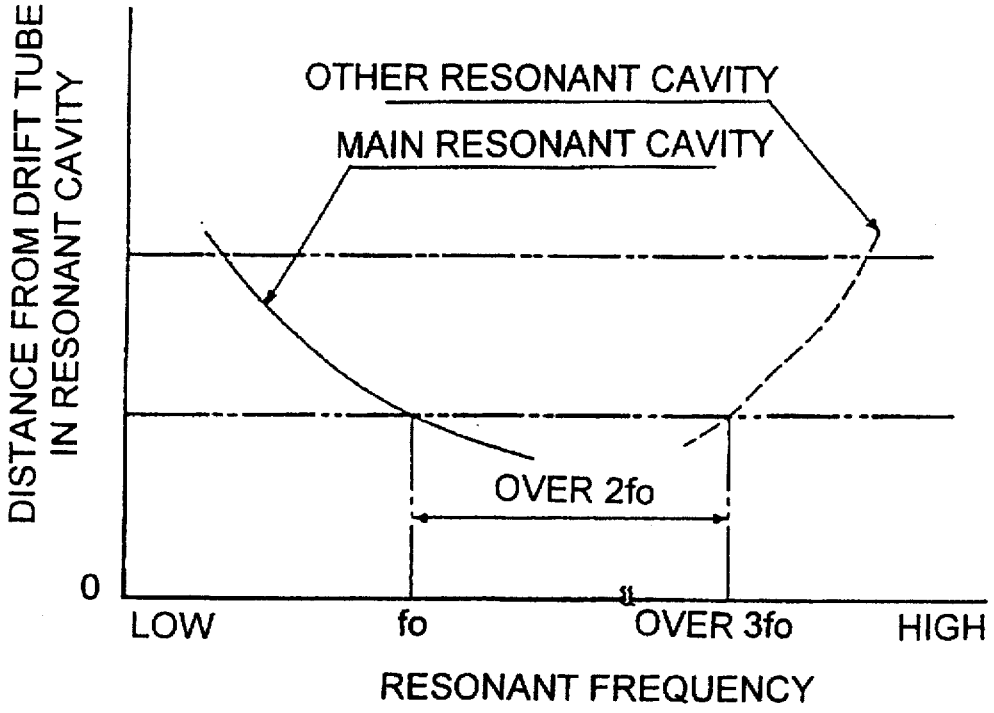
FIG.6 PRIOR ART
FIG. 6 is a diagram showing the relationship between the resonant frequency of a main resonant cavity and the resonant frequency of another resonant cavity of the conventional arrangement shown in FIG. 5.
Figure 7:
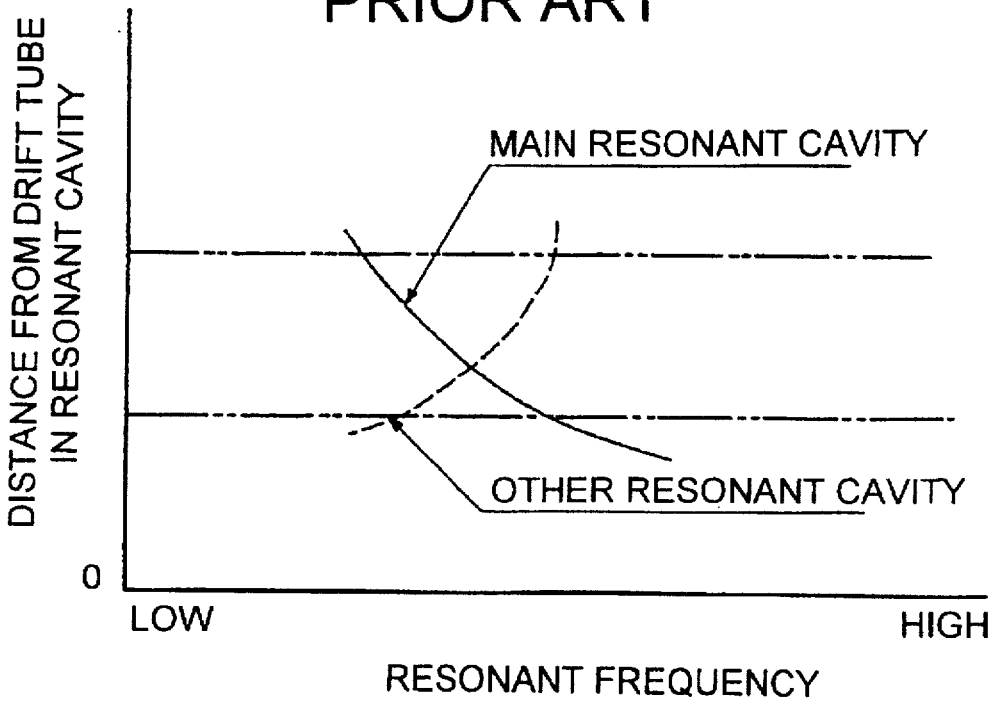
FIG.7 PRIOR ART
FIG. 7 is a diagram showing the manner in which resonant frequency of a main resonant cavity and the resonant frequency of another resonant cavity coincides with each other in a conventional cavity resonator that varies the resonant frequency by varying the reactance.

Furthermore, it is also clear that the relationship shown in FIG. 4 can be satisfied by increasing only the dimension A with the configurations of the second embodiment of the present invention.

The multiple cavity klystron according to the second embodiment of the present invention is more advantageous than the multiple cavity klystron according to the first embodiment of the present invention in that it can easily be designed because of fewer dimensional limitations.

The multiple cavity klystron according to the present invention offers the following advantages:

As described above, the dimensions L, A, B, E, R can be determined to keep the operating frequency of a first resonant cavity (main resonant cavity) of a RF circuit of a multiple cavity klystron out of coincidence with the resonant frequency of a second resonant cavity (another resonant cavity) in the frequency range that is used, thereby preventing electric characteristics of the main resonant cavity from being impaired. Specifically, it is possible to avoid an increased leakage of RF electric energy into the other resonant cavity, which would otherwise result in a reduction in the high-frequency electric energy in the main resonant cavity, and also to avoid a connection of the main resonant cavity to another main resonant cavity through the other resonant cavity. Therefore, the multiple cavity klystron according to the present invention has a wide range of frequencies in which it can be used and is capable of operating at high frequencies.

Although certain preferred embodiments of the present invention have been shown and described in detail, it should be understood that various changes and modifications may be made therein without departing from the scope of the appended claims.

What is claimed is:

1. A multiple cavity resonant structure for a klystron comprising:

a cavity casing having a first wall and a second wall displaced in an axial direction from said first wall, said second wall having a hole formed therein;

a tuning device disposed in said cavity casing for varying an inductance thereof;

a drift tube mounted on said cavity casing between said first wall and said tuning device, said drift tube extending along a first axis substantially perpendicular to said axial direction;

a tuning device support connected to said tuning device;

a connecting rod having an end thereof connected to said tuning device support, and having an opposite end thereof extending outside of said cavity casing out of contact therewith through said hole defined in said second wall of the cavity casing and extending into said cavity casing so as to space said tuning device a distance L in said axial direction from said second wall; and a bellows connected to a portion of said connecting rod outside of said cavity casing and to an outside portion of said cavity casing, for hermetically sealing said tuning device;

wherein said tuning device, said first wall, a first length of said cavity casing, and said drift tube define a first resonant cavity and are dimensioned and arranged such that said first resonant cavity has a predetermined operating frequency and wherein said tuning device, said connecting rod, a second length of said cavity casing, and said second wall define a second resonant cavity and are dimensioned and arranged such that said second resonant cavity has a plurality of resonant frequencies in TEM and $TE_{11}$ modes, and wherein said dimensions and arrangement of said second resonant cavity is such that at least one of said plurality of resonant frequencies in said TEM and $TE_{11}$ modes of said second resonant cavity is lower than the operating frequency of said first resonant cavity, and each of said plurality of resonant frequencies in TEM and $TE_{11}$ modes of said second resonant cavity is different from the operating frequency of said first resonant cavity.

2. A multiple cavity resonant structure for a klystron according to claim 1, wherein said dimensions and arrangement of said first resonant cavity and of said second resonant cavity includes said distance L between the tuning device of said second resonant cavity and said second wall being such that said at least one of said plurality of resonant frequencies in said TEM and TE11 modes of said second resonant cavity is lower than the operating frequency of said first resonant cavity, and each of said plurality of resonant frequencies in TEM and TE11 modes of said second resonant cavity is different from the operating frequency of said first resonant cavity.

3. A multiple cavity resonant structure for a klystron according to claim 1, wherein said dimensions and arrangement of said first resonant cavity and of said second resonant cavity includes said connecting rod having a diameter R such that said at least one of said plurality of resonant frequencies in TEM and TE11 modes of said second resonant cavity is lower than the operating frequency of said first resonant cavity, and each of said plurality of resonant frequencies in said TEM and TE11 modes of said second resonant cavity is different from the operating frequency of said first resonant cavity.

4. A resonant structure for a klystron comprising:

a cavity casing having a first wall, and a second wall displaced in an axial direction from said first wall, said second wall having a hole formed therein;

a rod extending into said cavity casing through said hole in said second wall;

means, cooperatively connected to a portion of said connecting rod outside of said cavity casing and to an outside portion of said cavity casing, for hermetically sealing said tuning device;

a tuning device support connected to an end of said rod inside said cavity casing, said tuning device support having a length C in a first direction substantially perpendicular to said axial direction, a length D in a second direction substantially perpendicular to said first direction and to said casing axis, and a length E in a direction parallel to said axial direction;

a tuning device connected to said tuning device support; and a tube mounted to said cavity casing between said first wall and said tuning device, said tube extending along a first axis substantially perpendicular to said axial direction;

wherein said tuning device, said first wall, a first length of said cavity casing, and said drift tube define a first resonant cavity having an operating frequency, wherein said tuning device, said rod, a second length of said cavity casing, and said second wall define a second resonant cavity having a plurality of resonant frequencies in TEM and TE11 modes, and wherein said lengths C, D, E are such that at least one of said plurality of resonant frequencies in said TEM and TE11 modes of said second resonant cavity is lower than the operating frequency of said first resonant cavity.

5. A resonant structure for a klystron according to claim 4, wherein said lengths C, D, E are such that each of said plurality of resonant frequencies in said TEM and TE11 modes of said second resonant cavity is different from the operating frequency of said first resonant cavity.

6. A resonant structure for a klystron further according to claim 4 further comprising means, cooperatively connected to a portion of said connecting rod outside of said cavity casing and to an outside portion of said cavity casing, for hermetically sealing said tuning device.

7. A resonant structure for a klystron comprising:

a cavity casing having a first wall and a second wall displaced in an axial direction from said first wall, said second wall having a hole formed therein, and having an upper wall and a lower wall extending in a pair of respective first planes substantially parallel to said axial direction, said upper wall and lower wall spaced from each other by a distance A, and having a left wall and a right wall extending in a pair of respective second planes substantially parallel to said axial direction and substantially perpendicular to said first planes, said left wall and said right wall spaced from each other by a distance B;

a rod extending into said cavity casing through said hole in said second wall;

a tuning device connected to said rod within said cavity casing;

a tube mounted to said cavity casing between said first wall and said tuning device, said tube extending in a third direction substantially perpendicular to said axial direction, wherein said tuning device, said tube, said first wall, a first portion of said upper wall, said lower wall, said left wall and said right wall between said tuning device and said first wall define a first resonant cavity having an operating frequency, wherein said tuning device, said connecting rod, said second wall and a second portion of said upper wall, said lower wall, said left wall and said right wall between sold tuning device and said first wall define a second resonant cavity having a plurality of resonant frequencies in TEM and $TE_{11}$ modes, and wherein said dimensions A and B are such that one of said plurality of frequencies in said TEM and $TE_{11}$ modes of said second resonant cavity is lower than the operating frequency of said first resonant cavity.

8. A resonant structure for a klystron according to claim 7 further comprising a tuning device support for connecting said tuning device to said rod within said cavity casing.

9. A resonant structure for a klystron according to claim 7, wherein said dimensions A and B are such that each of the other of said plurality of resonant frequencies in said TEM and TE11 modes of said second resonant cavity is different from the operating frequency of said first resonant cavity.

10. A resonant structure for a klystron according to claim 7 further comprising means, cooperatively connected to a portion of said connecting rod outside of said cavity casing and to an outside portion of said cavity casing, for hermetically sealing said tuning device.

* * * * *